United States Patent [19]

Bonaventure et al.

[11] Patent Number: 5,005,303

[45] Date of Patent: Apr. 9, 1991

[54] ALPINE SKI BOOT

[75] Inventors: Laurent Bonaventure, Annecy; Jean-Marie Begey, Bonne; Claude Perrissoud, Saint-Jorioz; Serge Lagier, Rumilly, all of France

[73] Assignee: Salomon S.A., Annecy Cedex, France

[21] Appl. No.: 447,815

[22] Filed: Dec. 8, 1989

[30] Foreign Application Priority Data

Dec. 9, 1988 [FR] France ..... 88 16507

[51] Int. Cl.[5] ..... A43B 5/4

[52] U.S. Cl. ..... 36/120; 36/117

[58] Field of Search ..... 36/117-121

[56] References Cited

U.S. PATENT DOCUMENTS

| | | | |
|---|---|---|---|
| 3,975,838 | 8/1976 | Martin | 36/121 |
| 4,299,039 | 11/1981 | Hanson | 36/117 |
| 4,372,061 | 2/1983 | Pozzobon | 36/117 |
| 4,539,764 | 9/1985 | Pradier | 36/121 |
| 4,561,196 | 12/1985 | Petrini et al. | 36/118 |
| 4,587,747 | 5/1986 | Courvoisier et al. | 36/117 |
| 4,601,118 | 7/1986 | Zanatta | 36/121 |
| 4,649,657 | 3/1987 | Iwama | 36/117 |
| 4,658,517 | 4/1987 | Miyoshi et al. | 36/117 |
| 4,660,302 | 4/1987 | Arieh et al. | 36/117 |
| 4,905,384 | 3/1990 | De Marchi et al. | 36/117 |

FOREIGN PATENT DOCUMENTS

| | | | |
|---|---|---|---|
| 385637 | 8/1985 | Austria . | |
| 0074513 | 3/1983 | European Pat. Off. | 36/121 |
| 3530243 | 3/1983 | Fed. Rep. of Germany | 36/117 |
| 3431746 | 3/1985 | Fed. Rep. of Germany . | |
| 2540359 | 8/1984 | France . | |
| 2574045 | 6/1986 | France . | |
| 561031 | 4/1975 | Switzerland . | |

OTHER PUBLICATIONS

Search Report for French Application No. 88.16507.

*Primary Examiner*—Paul T. Sewell
*Assistant Examiner*—Ted Kavanaugh
*Attorney, Agent, or Firm*—Sandler, Greenblum & Bernstein

[57] ABSTRACT

A rear-entry ski boot having a rigid shell and an upper constituted by a front cuff and a rear spoiler, and system for fastening and adjusting the boot on the lower leg of the skier. The upper includes a central sleeve journalled on the shell base and having a front opening and a rear opening defined by the two lateral walls of the upper part; a rear spoiler journalled on the sleeve and adapted to close the rear opening of the sleeve; and a front cuff journalled on a lower front zone of the sleeve and adapted to close the front opening of the sleeve. With the construction of the ski boot, the upper is made adjustable to more effectively support the skier's lower leg. Various latching mechanisms and locking mechanisms are also provided.

46 Claims, 10 Drawing Sheets

FIG: 9
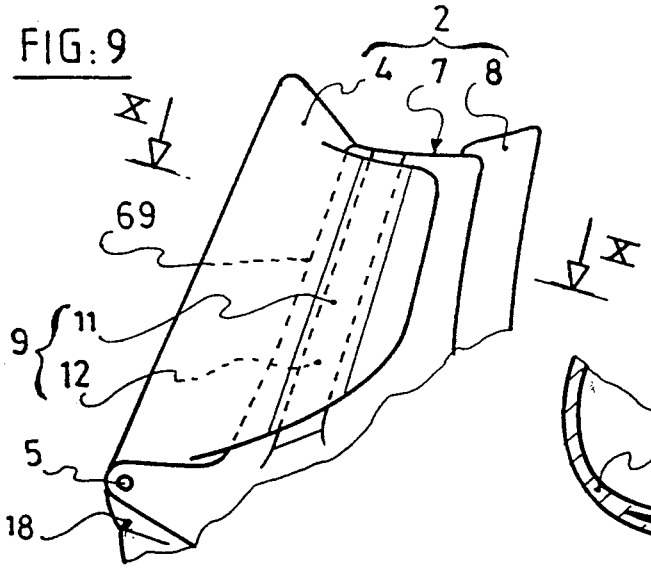
FIG: 10
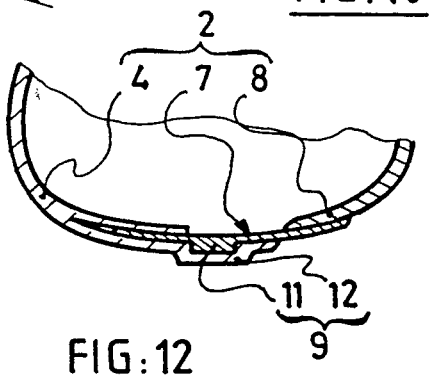
FIG: 11
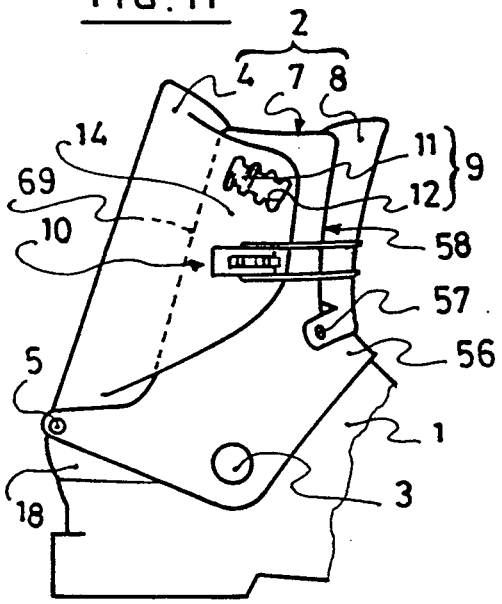
FIG: 12
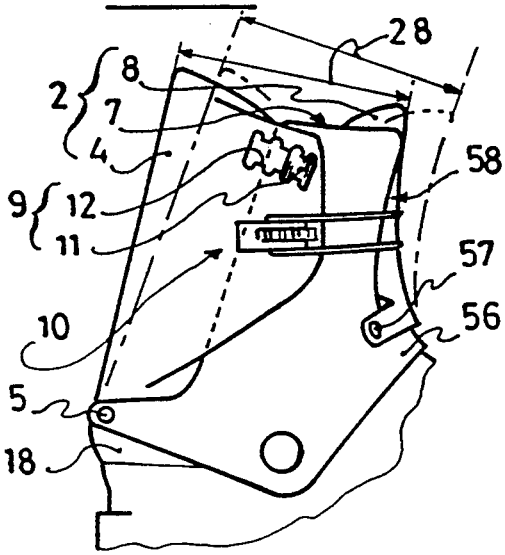
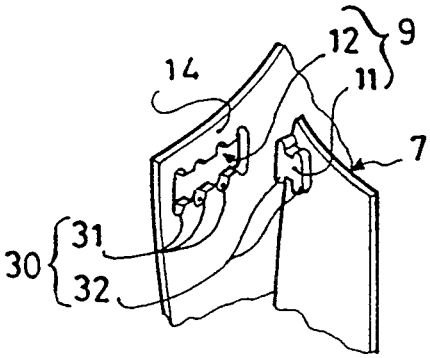
FIG: 13

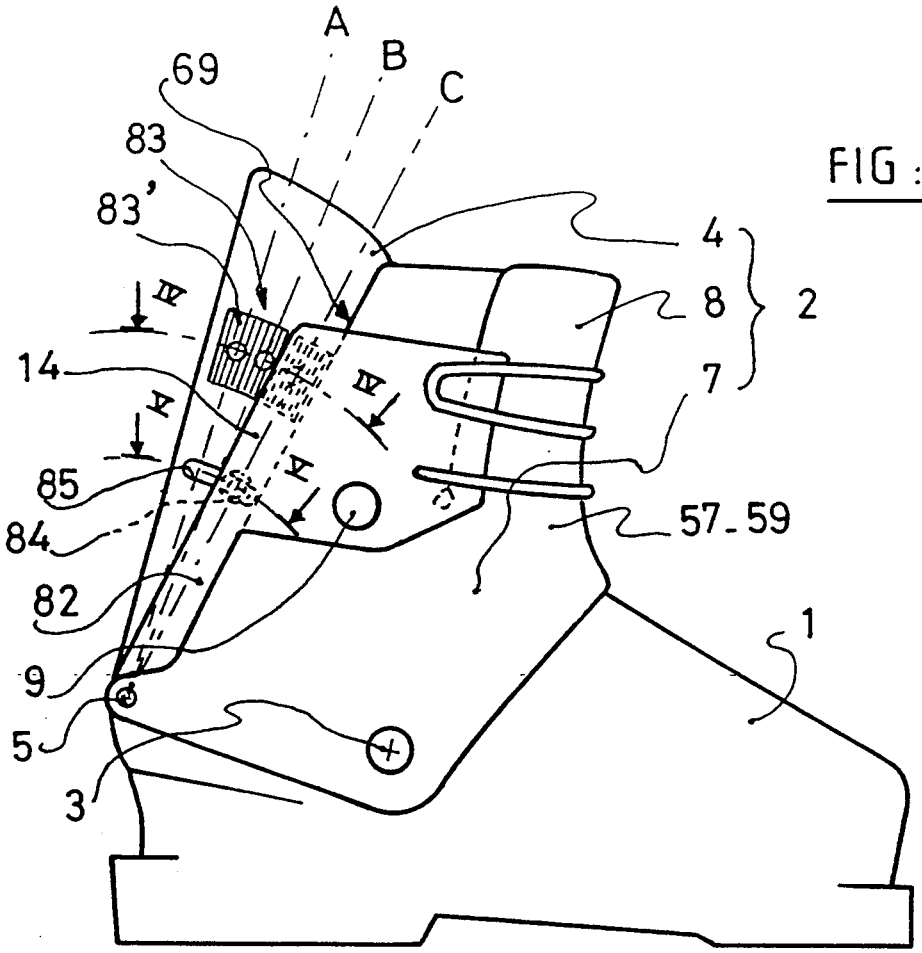
FIG: 23
FIG: 24
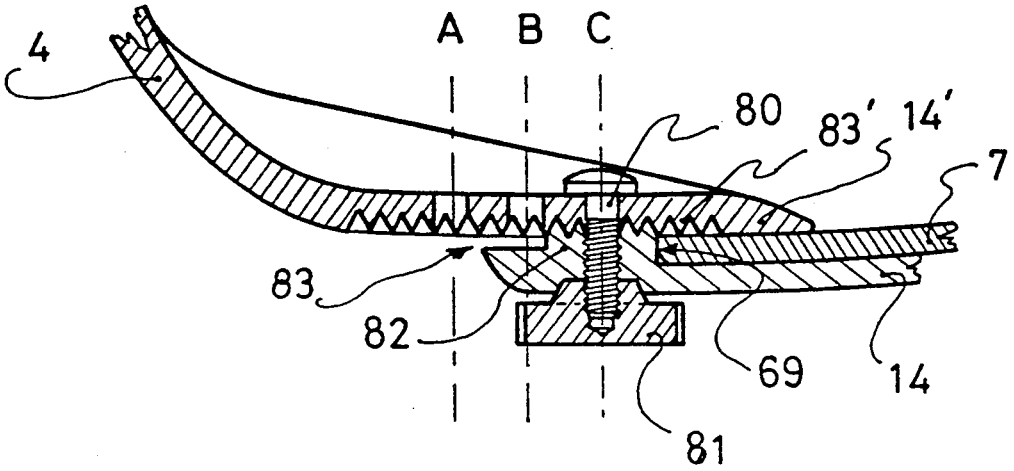

FIG: 25
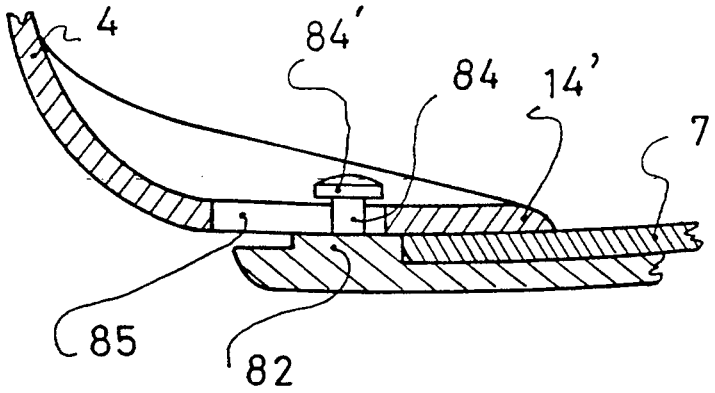
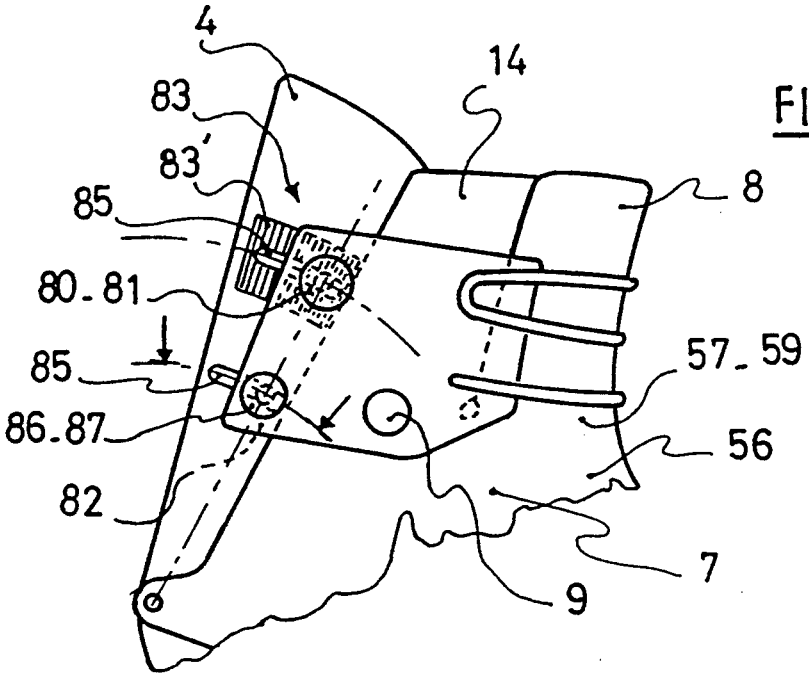
FIG: 26
FIG: 27
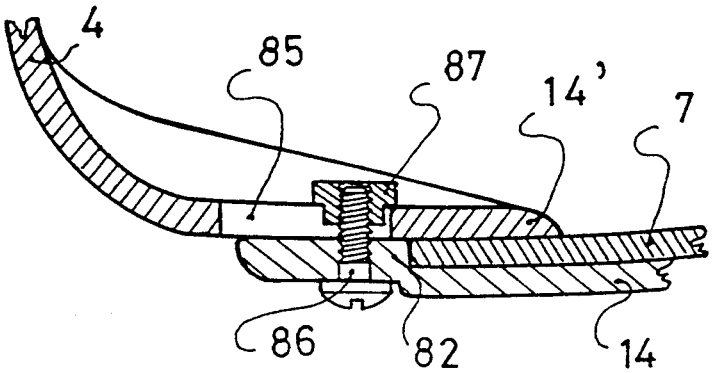

ALPINE SKI BOOT

BACKGROUND OF THE INVENTION

1. Field of the Invention

The present invention relates to a rear-entry ski boot having a rigid shell and an upper constituted by a front cuff and a rear spoiler, and to a system for fastening and adjusting such boots on the lower leg of the skier.

2. Discussion of Background Information

The aforementioned type of rear-entry ski boot generally comprises an upper whose front cuff, journalled on the shell base, has a rear extension on which the rear spoiler is mounted so as to be displaced with respect to the front cuff between a position for holding and/or pressing against the skier's lower leg, and a position in which the rear spoiler is opened for allowing the passage of the foot of the skier. Moreover, in its position of holding the lower leg, the rear spoiler likewise constitutes a support element for the lower leg in the antero-posterior direction.

The adjustment of such boots on the lower leg of the skier is obtained by moving together and holding the rear spoiler against the front cuff, either under the effect of a fastening device, acting between the cuff and the spoiler, or by means of a device for latching the spoiler and the cuff together.

It follows that the quality of rear support of the lower leg on the rear spoiler is dependent on the rigidity of the fastening or latching devices. On the other hand, these devices being located most often in the upper part of the upper, the rear support is likewise a function of the dimensional stability of the latter and of its area of abutment on the shell base.

French Pat. Nos. 2,540,359 and 2,575,045 and Austrian Pat. No. 385,637 describe ski boots of this type. French Pat. No. 2,540,359 discloses a boot whose upper, constituted by a front cuff and a rear spoiler, is latched in a closed position on the lower leg of the skier by an elastic device preventing any relative displacement of the rear spoiler and front cuff between them, whatever the pivoting movement of the upper with respect to its journal axis on the shell base. In such a boot construction, the adjustment of the upper on the skier's lower leg remains random, since it is as much dependent on the position of the device for latching the cuff and spoiler to one another as on the volume of the skier's leg. Further, if the retention of the rear spoiler on the front cuff is very rigid through the use of the latching device, the rear support of the leg with respect to the shell base remains uncertain because it is dependent upon the dimensional stability of the front cuff between its abutment area located on the instep and the latch.

In the case of the boot construction described in Austrian Pat. No. 385,637, the fastening of the upper is performed by pivoting the rear spoiler against the abutments supported by the front cuff and, as a result, the adjustment of the upper on the lower leg is not always achieved. In fact, these abutments limit the possible position where the rear spoiler comes together with the front cuff. Nevertheless, these abutments do not participate in the retention of the rear spoiler in the antero-posterior direction, which instead is ensured by a fastening device ensuring that the parts of the upper are maintained toward the lower leg. As mentioned above, such a construction does not provide a rigid rear support for the leg with respect to the shell base. Likewise, because of the absence of a latching device, the retention of the rear spoiler in the antero-posterior direction is essentially dependent upon the dimensional stability of the fastening device.

The boot described in French Pat. No. 2,575,045 has an upper structure in which the rear spoiler is brought together and held against the front cuff, without any particular limitation of its clearance, by means of a fastening device acting between the cuff and the spoiler. Such a structure makes it possible to adjust the gripping force of the upper on the lower leg. Nevertheless, because the cuff and the spoiler still remain free for relative movement between them in the posterior-antero direction, this structure is likely to cause undesirable friction on the lower leg during skiing. Moreover, if the support of the leg by the upper towards the rear is located in the area of the heel, the fact remains that the rigidity of this support remains dependent upon the dimensional stability of the fastening device.

As just described, the function of adjustment of the upper on the skier's lower leg and the function of rear support for the lower leg on the rear spoiler with respect to the shell base are poorly fulfilled. That is, either the adjustment is achieved and the rear support is uncertain, or the rear support is rigid and firm and the adjustment is poorly achieved.

SUMMARY OF THE INVENTION

An object of the present invention, therefore, is to provide a boot which ensures a firm and solid retention of the rear spoiler with the front part of the upper in the antero-posterior direction, and vice-versa, particularly provided with adjustability for the latter, and to provide a rigid rear support for the lower leg by the upper on the shell base.

According to the invention, the ski boot includes a shell base having an upper at least partially journalled on the latter and cooperating during biases in rear support with the abutment means fixed with respect to the shell base, and a device for gripping and fastening the upper on the lower leg.

According to one aspect of the invention, the upper comprises:

a central part, or central sleeve, journalled about an axis directly on the shell base and comprising extensions extending towards the rear from the journal axis, the upper part of the sleeve defining a front opening and a rear opening defined by the two lateral walls, of the upper part, a rear spoiler journalled on an axis at the end of the extensions and adapted to close the rear opening of the sleeve, and a front cuff journalled on an axis located in the lower front zone of the sleeve and adapted to close the front opening of the sleeve.

The boot of the present invention also includes means for latching the rear spoiler and the sleeve, ensuring the holding of the rear spoiler in a closed position on the sleeve, whereby the front cuff is adapted to be held in a closed position on the front cuff on a front part of the sleeve by means of the fastening and tightening means.

According to one embodiment of the invention, the latching means and the fastening and tightening means are positioned at different heights on the upper and, according to another embodiment, the latching means and the fastening and tightening means are positioned at generally the same height on the upper.

According to a further embodiment, the rear spoiler is held in a latched position on the sleeve independently of the fastening and tightening means on the front cuff and, according to another embodiment, the rear spoiler is held in a latched position on the sleeve by means of the fastening and tightening means on the front cuff.

According to another aspect of the invention, the latching means are positioned both on the rear spoiler and on the sleeve for selectively positioning the rear spoiler and the sleeve relative to each other.

According to another aspect of the invention, the latching means includes raised elements, which extend transversely to the thickness of the walls of the upper, and hollowed portions which cooperate with the raised elements.

Still further according to this aspect of the invention, the raised elements are shaped complementary to that of the hollowed portions, and the raised elements are positioned on one of the rear spoiler and the sleeve, and the hollow portions are positioned on the other of the rear spoiler and the sleeve.

Still further, one of the raised elements and the hollow portions is arranged on one of the rear spoiler and the sleeve and further includes means for adjusting the position of the one.

In a certain embodiment of the invention, the position adjustment means include a succession of grooves provided in the hollow portions, generally coaxial with the first axis, and ribs affixed to the raised elements, and the ribs cooperate with the grooves.

In another embodiment of the invention, the position adjustment means includes a reversible offset ring positioned in the wall of the sleeve, the ring ensuring the position of the raised element by means of a threaded rod extending through the wall of the sleeve, the raised element being adapted to lodge in the wing of the rear spoiler.

According to another aspect of the invention, the raised elements and the hollow portions include engagement ramps for facilitating the nesting of the raised elements and the hollow portions during fastening of the rear spoiler on the upper.

According to a further aspect of the invention, means are provided for locking the raised elements and the hollow portions of the latching means in position.

Further according to the invention, the rear spoiler includes two lateral wings extending in a direction to be adjacent the lateral walls of the sleeve, the lateral wings include one of the raised elements and the hollow portions of the latching means.

Still further, the wings of the rear spoiler are elastically deformable in a direction generally transverse to the longitudinal axis of the boot.

Further according to the invention, the wings are provided as a single piece molded with the rear spoiler.

In a certain embodiment of the invention, the wings are provided as independent elements each provided with a mechanical connection assembly.

In another embodiment of the invention, the wings of the rear spoiler at least partially cover the walls of the sleeve in a fastened position of the upper.

In a further embodiment of the invention, the wings of the rear spoiler extend interiorly of the walls of the sleeve in a fastened position of the upper.

According to the invention, the lateral walls of the sleeve extend towards the rear of the upper in a manner adjacent to the lateral wings of the rear spoiler.

Further according to the invention, the lateral walls are elastically deformable in a direction generally transverse to the longitudinal axis of the boot.

Still further according to the invention, an adjustment device is provided which is positioned between the shell base and the sleeve for effecting angular adjustment of the sleeve in an antero-posterior direction.

Still further, an abutment is provided on the shell and the sleeve cooperates with the shell base during rearward biases by means of the abutment.

Still further, the fastening and tightening means includes at least one flexible, generally inextensible linkage element resting on the front cuff and means for hooking and tensioning the flexible tie located on one of the rear spoiler and the sleeve, the hooking and tensioning means are located on each of the sides of the upper.

According to a still further aspect of the invention, the fastening and tightening means includes at least one flexible, generally inextensible linkage element resting on the front cuff and return means for the tie located on each side of the upper on the sleeve and means for tensioning the linkage element located on a rear portion of the rear spoiler, guidance means are provided to hold the tie in position on the front cuff.

Further according to the invention, the front opening of the sleeve is totally covered by the front cuff.

In another aspect of the invention, the front opening of the sleeve is closed by the front cuff, and the front cuff extends partially within the upper and is journalled outside of and on a lower front part of the sleeve.

It is a further object of the present invention to provide a ski boot which includes:

(a) a shell base;

(b) an upper journalled on the shell base, the upper including:

(i) a central portion journalled with respect to the shell base, the central portion having a front opening and a rear opening defined by two lateral walls of the central portion;

(ii) a rear spoiler for closing the rear opening of the central portion; and (iii) a front cuff for closing the front opening of the central portion; and (c) means for fastening and tightening the upper on the lower leg.

According to a one aspect of the invention, the central portion is journalled about a first generally horizontal axis with respect to the shell base, and the rear spoiler is journalled about a second generally horizontal axis rearward of the first axis.

According to another aspect of the invention, the central portion is journalled about a first generally horizontal axis with respect to the shell base, and the rear spoiler is journalled about a second generally vertical axis rearward of the first axis.

A means is provided according to the invention for latching the rear spoiler on the central portion.

In one aspect of the invention, the means for latching the rear spoiler on the central portion is locked in a predetermined position by the means for fastening and tightening.

In another aspect of the invention, the means for latching the rear spoiler on the central portion is locked in a predetermined position by means independent of the means for fastening and tightening. Specifically, according to one aspect of the invention, the independent means includes a locking device which includes a linkage element which extends from one lateral wall of the central portion to another of the lateral walls.

In a still further aspect of the invention, the latching means includes a raised member and a cooperating depression on respective ones of the lateral walls of the central portion and respective ones of the wings of the rear spoiler.

In a still further aspect of the invention, the latching means further includes means for adjusting the position of the rear spoiler on the central portion, the means for adjusting being independent of the means for fastening and tightening.

In a still further aspect of the invention, means are provided for angularly adjusting the longitudinal position of the central portion on the shell base.

In a specific embodiment, the means for angularly adjusting the longitudinal position of the central portion on the shell base includes a wedge insertable between a portion of the central portion and a portion of the shell base.

According to another aspect of the invention, the rear spoiler includes at least one wing which extends in correspondence with a wall of the central sleeve in the fastening position of the upper, a latching means being positioned both on the rear spoiler and the sleeve to cooperate with each other. These latching means extend transversely to the wing of the rear spoiler and to the wall of the sleeve for at least one predetermined relative position between these two parts of the upper and in that, in addition, the front cuff is subjected to the action of a device for gripping and fastening on the lower leg independently from the latching of the rear spoiler on the sleeve of the upper. The sleeve supports the rear spoiler and the front cuff. Thus, the rear support for the leg provided by the upper with respect to the shell base is transmitted by means of the sleeve on the latter by means of two complementary zones of abutment provided on the sleeve and the shell base.

BRIEF DESCRIPTION OF THE DRAWINGS

Additional objects, features, and advantages of the present invention will become apparent with reference to the following description which is presented, by way of non-limiting examples, with respect to the accompanying exemplary drawings, in which:

FIGS. 9 and 10 illustrate another embodiment for the latching of the rear spoiler on the upper;

FIGS. 11–15 are partial views of boots according to the invention in which the latching means are adjustable in position on the rear spoiler and/or on the upper;

FIGS. 23–25 illustrate an alternative embodiment of a boot, still according to the invention, comprising a rear spoiler whose wings are mounted by mechanical assembling on the latter and adjustable in position, FIGS. 24 and 25 being partial sections of the boot of FIG. 23 viewed along line IV—IV and line V—V, respectively; and FIGS. 26 and 27 show another possible construction of a rear spoiler with the wings mounted on the central sleeve.

DETAILED DESCRIPTION OF THE PREFERRED EMBODIMENTS

Figure 1:
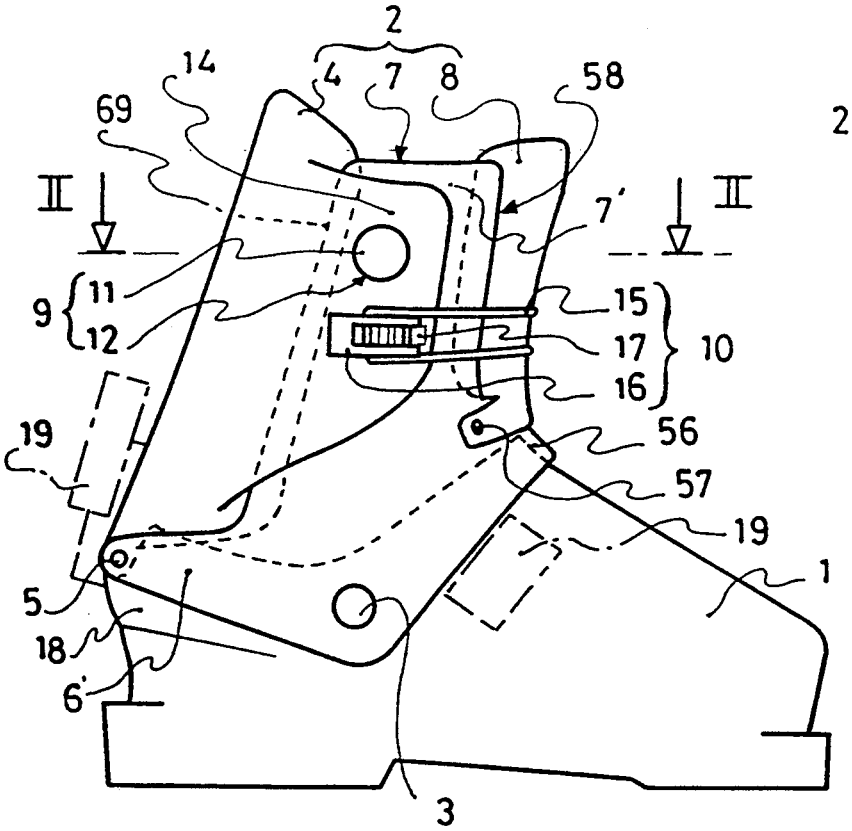
FIG. 1 illustrates a rear-entry boot having a rear spoiler which is latched by the exterior on the upper, independently of the front cuff which is adjustably positioned on the lower leg.

The ski boot shown in FIG. 1 is a boot of the "rear entry" type and comprises a rigid shell base 1 on which an upper 2 is at least partially journalled about an axis 3 connecting it to the shell base. This axis is located approximately in the zone corresponding to the malleolus of the foot of the skier. In a manner known per se, upper 2 includes a rear spoiler 4 which is movable with respect to a front part to allow the introduction of the foot in the boot and to permit its disengagement. In this example, the rear spoiler 4 is movable on a substantially horizontal axis 5 supported by two rear and lateral lower extensions 6 of the front part of the upper. According to a characteristic of the invention, the upper 2 is constituted by a rear spoiler 4, a front cuff 8, and a central sleeve 7, which comprises extensions 6 which are connected to the shell base 1 by means of axis 3.

The central sleeve 7 has a front opening 58 and a rear opening 69 which are, on the one hand, defined by lateral walls 7' and 7'' and, on the other hand, closed by the front cuff 8 and the rear spoiler 4, respectively. Another characteristic of the invention is to provide the rear spoiler 4 and sleeve 7 with a latching means 9 adapted to render these elements of upper 2 inseparable and rigid between them, in a manner equivalent to a monobloc construction, and to subject the front cuff 8 to the action of a fastening device 10 to ensure the adjustment and holding of the skier's lower leg in the upper 2 of the boot. This arrangement of the constitutive parts of upper 2 has the effect of locking the skier's lower leg in the antero-posterior direction, a direction the same as that of the rear support of the lower leg during skiing, as well as that of gripping which applies universally to the instep by known internal foot holding devices, used in boots having a rigid shell.

Complementary to the arrangement of the constitutive parts of upper 2, shell base 1 is provided with an edge 18 which constitutes an abutment zone, which is provided facing the rear lateral extensions 6 of sleeve 7 which constitute the complementary abutment zone. Thus, when the skier requires the support of the lower leg in the antero-posterior direction on rear spoiler 4, the upper 2 pivots on its axis 3, until the extensions 6 of sleeve 7 abut against edge 18 of shell base 1. As a result, upper 2 directly transmits all forces on the shell base without dispersion, thereby obtaining the solidity of this rear support and a precise localization of the pressures generated by these forces on the rear part of the boot. According to the embodiment of the invention shown in FIGS. 1 and 2, the latching means 9 are constituted by nested elements, such as projections 11 and depressions or openings 12. These means 9 face the sides of the upper 2 on the sleeve 7 and on wings 14 of the rear spoiler 4 which extend transversely on each side of the upper, both between the sleeve 7 and the wings 14. Latching means 9 are adapted to be disengaged to allow the rocking of the rear spoiler 4 during insertion and removal of the foot, and it is provided for that purpose that at least one of the projections 11 or the openings 12 are retractable with respect to the other. In the embodiment shown in FIGS. 1 and 2, the openings 12 provided in wings 14 of rear spoiler 4 retract by transverse elastic deformation of said wings 14. Wings 14 of rear spoiler 4 must be able to be freed from the action of the fastening device 10 which rests thereon. In fact, according to this embodiment of the boot, the fastening device 10 is constituted by a tie 15, comprising a hooking means 16, which surrounds the front part of upper 2 over the front cuff 8, and a tension device 16' engaged in a rack 17, which are supported by wings 14 of rear spoiler 4. Thus tension device 16' will be rocked outside of rack 17 so as to disengage the front part of upper 2 from the covering of tie 15 to then separate the wings 14 from rear spoiler 4.

Figure 2A:
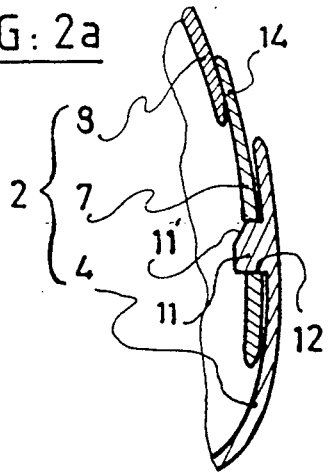
FIGS. 2 and 2*a* are sectional views along lines II—II of FIG. 1 and show possible details of the latching of the rear spoiler on the upper, FIG. 2*a* being constituted by two half-sections illustrating different embodiments of the rear spoiler.

Still without going beyond the invention, as is shown in FIG. 2*a*, projection 11 can be located, in a manner opposite to the preceding description, on wings 14 of rear spoiler 4 while opening 12 is obtained in the lateral walls 7', 7'' of sleeve 7. The unlatching of rear spoiler 4 still occurs then by elastic deformation of wings 14 of spoiler 4, but it is projection 11 which is disengaged with respect to opening 12 which remains in a relatively fixed position. Again, with the object of facilitating the placement of rear spoiler 4 on sleeve 7 in the latching position, the projecting elements 11 can preferably be provided with an engagement ramp 11'.

As shown in FIG. 1, upper 2 of the boot is subjected to the action of a pivoting control means 19 of a known type, schematically shown in broken lines. These means, adapted to absorb the forces of the lower leg on said upper in the postero-anterior direction in frontward flexion, are positioned between shell base 1 and sleeve 7 and/or between the shell base 1 and rear spoiler 4.

Figure 3:
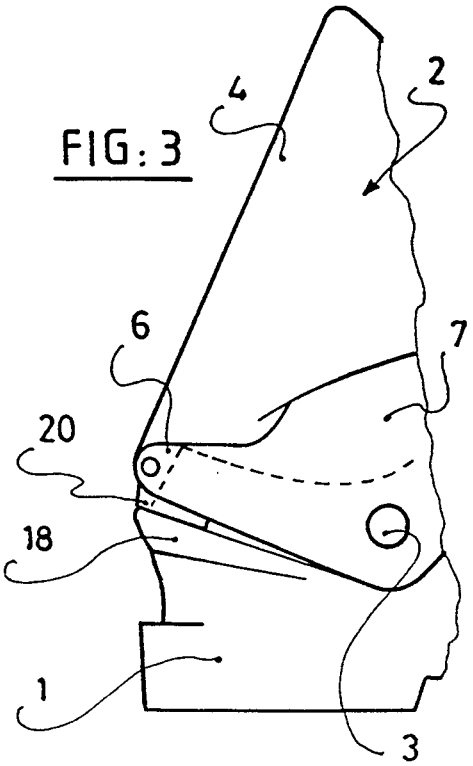
FIG. 3 is a partial elevation view of the boot shown in FIG. 1, provided with a device for adjusting the position of the upper.

As shown in FIG. 3, upper 2 is provided with a device 20 for adjustment of its angular position with respect to shell base 1 about its journal axis 3. In this example, the adjustment device 20 is preferably constituted by an angular wedge inserted between the edge 18 of shell base 1 and the rear extensions 6 of sleeve 7.

Figure 4:
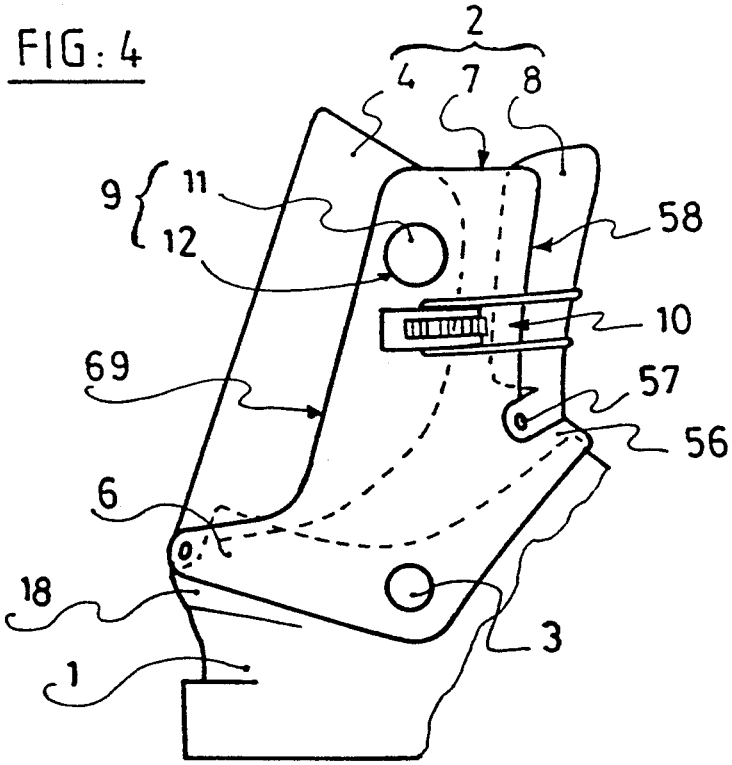
FIG. 4 illustrates a boot of the present invention in which the rear spoiler extends and latches within a central sleeve of the upper.

According to another embodiment of the invention shown in FIG. 4, wings 14 of rear spoiler 4 extend within the remainder of the upper 2 and comprise projections 11 which are latched by nesting in openings 12 provided on sleeve 7 in the inserted position. The latching of the projections within the openings is at least partially ensured by the property of elastic deformation of wings 14 of rear spoiler 4 in a transverse direction with respect to the longitudinal axis of the boot. Thus, by moving wings 14 together, the wings being part of the spoiler 4, the spoiler is freed to permit its opening by pivoting towards the rear. In the reverse, by rocking the spoiler towards the front, the separation of the elastically deformable wings 14 with respect to each other leads to the nesting of projections 11 supported by the wings which are lodged in the corresponding openings 12 of the sleeve. In this embodiment, the front cuff 8 is journalled, as previously mentioned, on the lower front part 56 of sleeve 7 with respect to the front opening 58, while rear spoiler 4 .is journalled on axis 5 of extensions 6 of the sleeve, with respect to the rear opening 69 of the latter.

Figure 5:
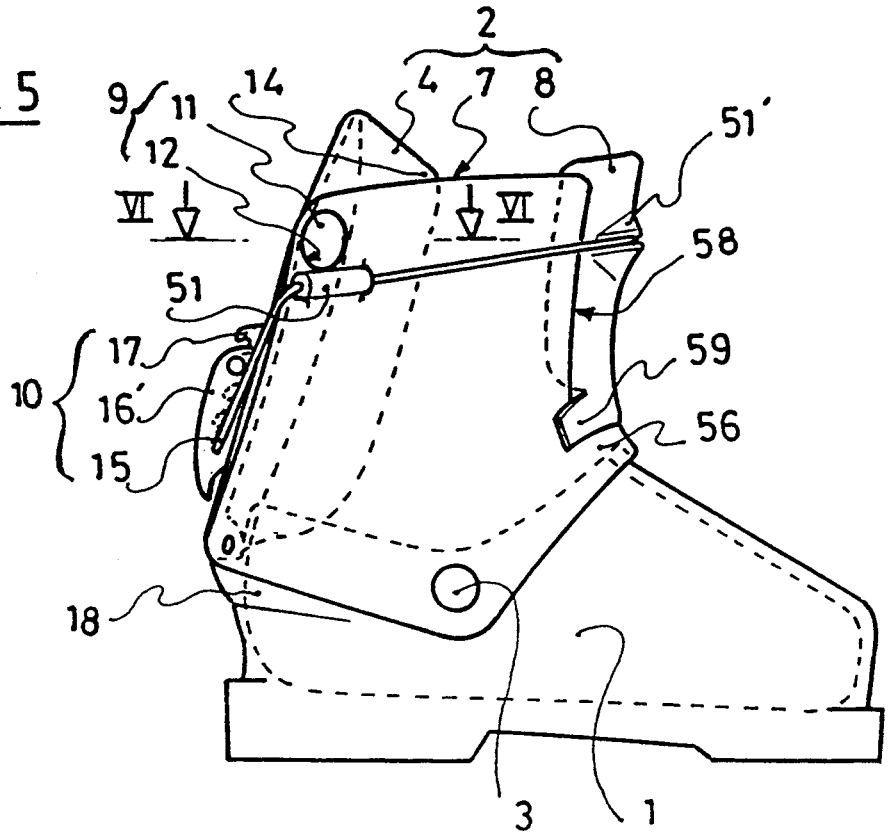
FIG. 5 is an elevation view of another embodiment of the present invention, showing another possible arrangement for the latching of the rear spoiler.
Figure 6:
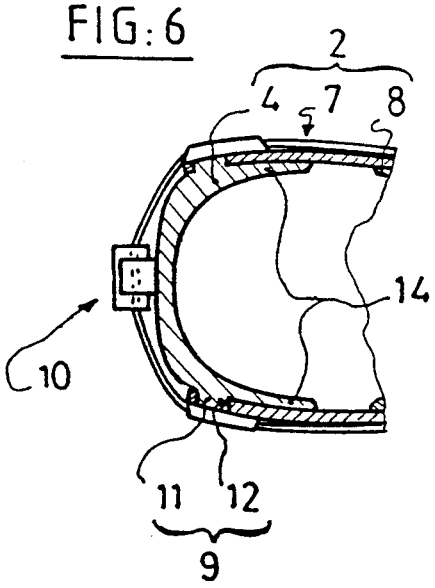
FIG. 6 is a partial sectional view of this arrangement along VI—VI of FIG. 5.

FIGS. 5 and 6 show another possible embodiment of the latching means 9 between the rear spoiler 4 and the sleeve 7 of the upper 2. In this construction, the latching means 9 are located on the rear part of upper 2. Sleeve 7 itself extends by elastically deformable lateral walls 7', 7'' and in a manner adjacent to wings 14 of spoiler 4 at the level of latching means 9. In this construction, the latching means 9 are situated at the rear of the rear part of upper 2. The latching means 9 are constituted by projecting elements 11 supported by rear spoiler 4 and by openings 12 provided on each of walls 7', 7'' of sleeve 7 in which the projecting elements 11 are nested. Preferably, the part of the latching means supported by the spoiler 4 constitutes a zone of maximum rigidity due to both the trough-shaped configuration of the spoiler and the raised configuration of the projecting elements 11 which reinforces the quality of the rear support of the skier's foot and leg during skiing. The latching means 9 can also be positioned on spoiler 4 and sleeve 7 in an opposite manner to that which was just described as was stated previously. The front cuff 8 is journalled on the rear of front part 56 of sleeve 7 simply by the support of lower lugs 59 of the cuff 8 on part 56, and the fastening device 10 is then supported by rear spoiler 4. In this example, the flexible linkage element 15 is guided on each side of the upper 2 on sleeve 7 by means of return means 51 supported by the latter and by guidance means 51' provided on cuff 8. The tensioning means, constituted by tension device 16', and rack 17 are then provided on rear spoiler 4.

Figure 7:
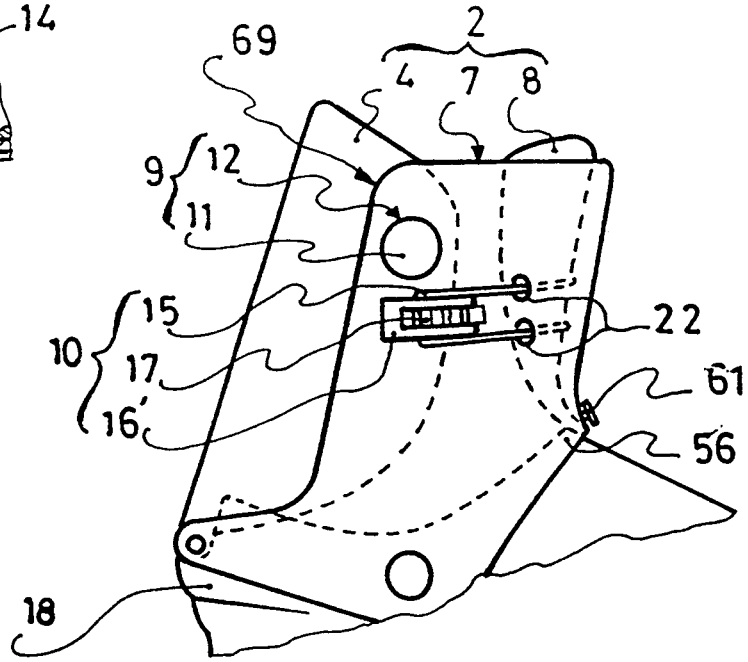
FIG. 7 shows an embodiment of the upper provided with a particular sleeve.

FIG. 7 illustrates an alternative embodiment of the invention of FIG. 4, but in which sleeve 7 covers any front part of upper 2 while the front cuff 8 is positioned to cover the tibial support of the skier's lower leg on the sleeve and is journalled within the latter to permit the gripping of cuff 8 on the lower leg, the tie 15 of the fastening device 10 is then passed through apertures 22 provided on both sides of sleeve 7. These apertures are substantially set back from front cuff 8, so that tie 15, which is under tension, rests on said cuff 8.

Figure 8:
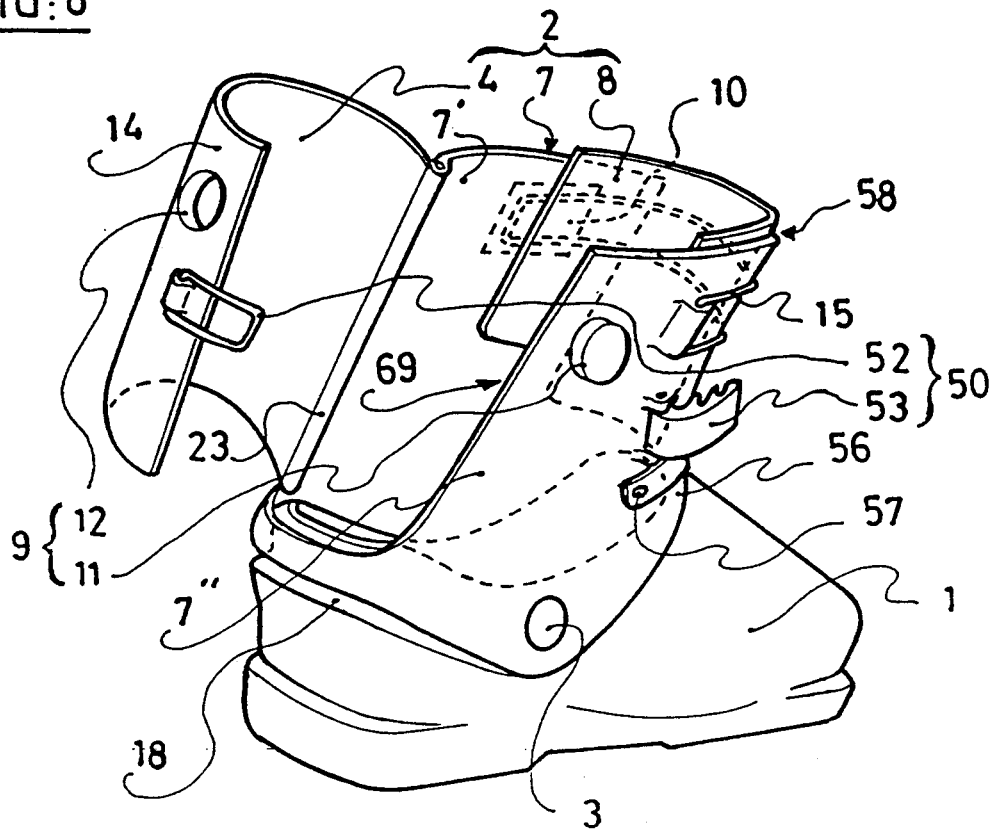
FIG. 8 illustrates another embodiment of the invention and shows a rear-entry boot whose rear spoiler is journalled about an axis substantially perpendicular to the plane of the sole of the boot.

Still according to the invention, in FIG. 8, upper 2 of the boot has a rear spoiler 4 journalled about a substantially vertical axis 23 situated on one of the walls 7' of sleeve 7, which covers the rear part of the lower leg by closing the rear opening 69 of the sleeve and extends by a single wing 14 on the other wall 7'' of the sleeve. The latching means 9, such as a projection 11 and a opening 12, are then positioned only on wall 7'' of sleeve 7 and on wing 14 of spoiler 4. In this embodiment, the fastening device 10 of the upper 2 on the lower leg is located on sleeve 7 and extends, by its tie 15, from one or the other of the walls 7', 7'' of the sleeve by surrounding the front cuff 8, but could also be supported alone by rear spoiler 4, or even for only a portion on rear spoiler 4 and sleeve 7 for as much as the tie 15 surrounds front cuff 8.

In the embodiments of the invention which were just described with reference to FIGS. 1–8, latching means 9 have been shown as projections 11 and openings 12 of a substantially circular shape with the openings extending completely through the sleeve 7 or wing 14. Latching means 9 can, alternatively, take other forms and openings 12 can be blocked, constituting depressions in a wall of the boot. Thus, for example, as is shown in FIGS. 9 and 10, the projections 11 are constituted by ribs and the openings 12 by grooves of respective shapes. Thus, latching of the upper is obtained by an assembly of a "tenon-mortise" type connection between rear spoiler 4 and sleeve 7.

In FIGS. 11–15 other embodiments of the latching means 9 according to the invention are illustrated. Therein, the latching means comprise means for adjustment 30 and 30' for the latching of the rear spoiler 4 with respect to the sleeve 7 of upper 2 and, as a result, of the extreme angular retention position of the skier's lower leg in the antero-posterior direction.

According to the example shown in FIGS. 11, 12, and 13, projections 11 have the form of plugs with ribbed sides 32, and the openings 12 are constituted by elongated and grooved openings 31 of equal width to the projections and having a complementary nesting form in the transverse direction. The means for adjustment 30 are constituted by the succession of grooves 31 of openings 12 which cooperate with ribs 32 of projections 11. Thus, from a very advanced latching position of rear spoiler 4 on sleeve 7, as shown in FIG. 11, it is possible to adjust the position of the rear spoiler to a more or less advanced position. FIG. 12 illustrates the least advanced position of the rear spoiler. It is obvious that, with respect to any modification of the latching position of the rear spoiler 4, the front cuff 8 will be displaced to a position to guarantee the same adjustment and/or gripping 28 of the lower leg, as shown schematically in dotted lines.

Figure 14:
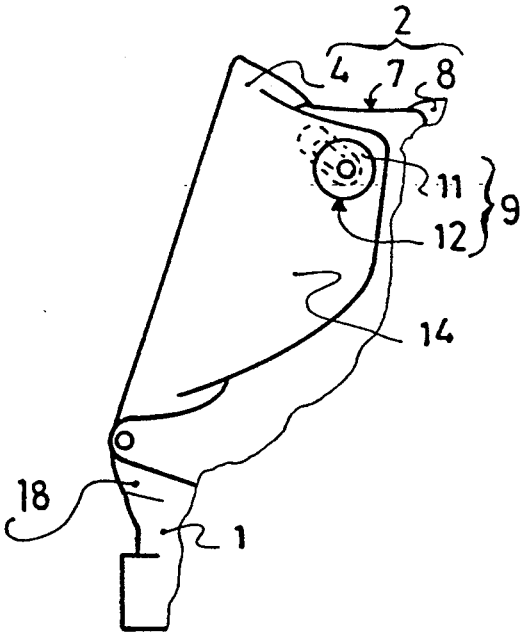
Figure 15:
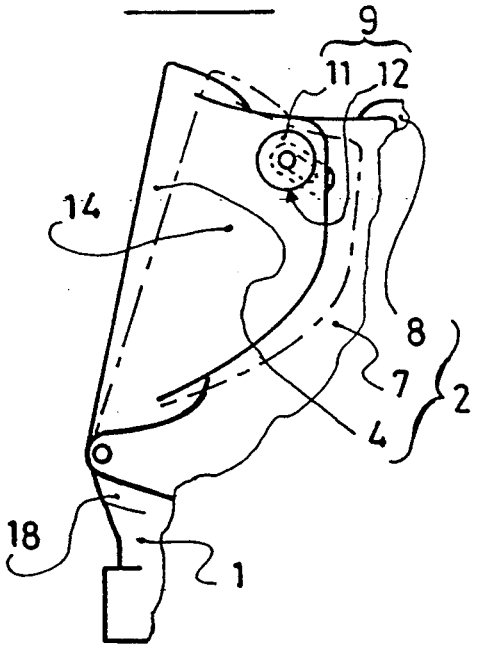
Figure 16:
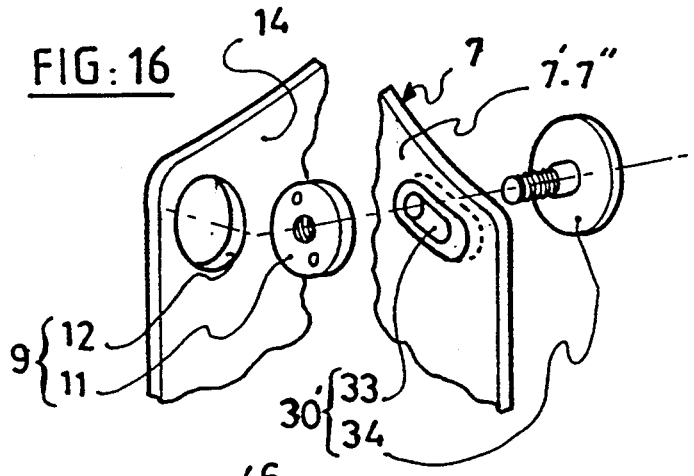

According to the example shown in FIGS. 14, 15, and 16, the adjustment means 30' are constituted by a reversible offset ring 33 placed in the wall of sleeve 7, the ring ensuring the position of the raised element 11 by means of a threaded rod 34 on the wall 7'-7'' of the sleeve, the element 11 being adapted to be lodged within wing 14 of rear spoiler 4. As was disclosed previously, the latching means 9, constituted by projections 11 and openings 12, are retractable with respect to one another by elastic deformation of the walls of sleeve 7 and/or by elastic deformation of wings 14 of rear spoiler 4 to allow the insertion-removal by release of the rear spoiler 4. The disengagement of the latching means 9 can also be carried out other than by elastically deforming the spoiler 4 and/or sleeve 7 without going beyond the scope of the invention.

Figure 17:
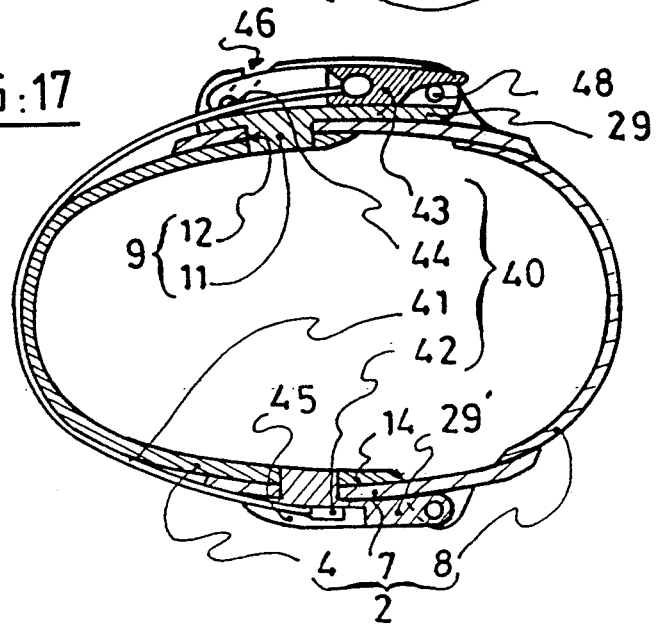
FIGS. 17, 18, and 18*a* are transverse sectional views of the upper of a boot conforming to the invention, illustrating another embodiment for latching the upper with the adaptation of a device for locking the latter in the fastened position.
Figure 18:
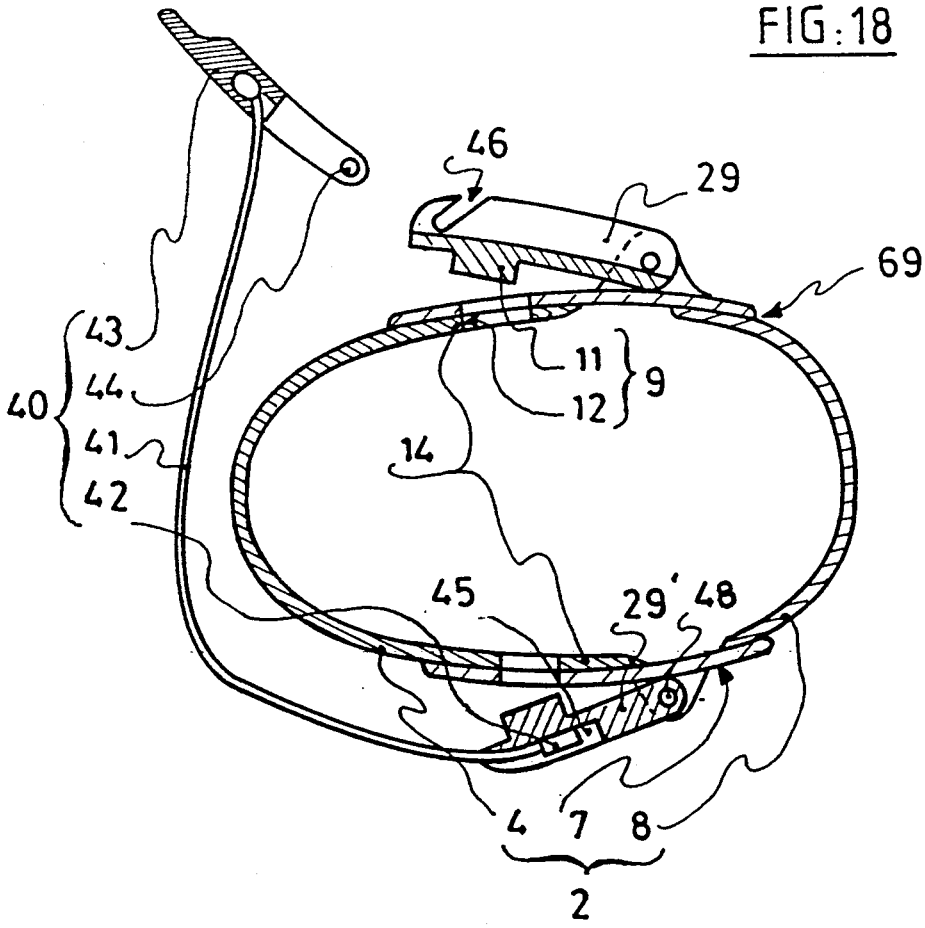

Thus, in FIGS. 17 and 18, which show a boot upper 2 according to the invention, the projections 11 are supported by arms 29, 29' solidly affixed to sleeve 7. The arms 29, 29' are journalled at 48 on the sleeve by means of which they are retractable by simple pivoting towards the exterior with respect to openings 12 provided on the rear spoiler 4. In this embodiment, each projection 11 extends through the corresponding wall of sleeve 7 and nests in the opening 12 of a complementary shape supported by rear spoiler 4, which is brought into a closed position of the upper on the lower leg. The retention and assembly of the latching means 9 between them are ensured not as discussed previously by the elastic return of wings 14 of spoiler 4 on the wall of sleeve 7, but by a locking device 40 for latching means 9 joined to arms 29 and 29'. This locking device 40 is constituted by a tensioning lever 43 to which a tie 41 and hooking elements 42, 44 are connected. These hooking elements cooperate, respectively, with the free ends of arms 29, 29'. To that end, the free end of arm 29 comprises a notch 46 which cooperates with the hooking element 44 of the tensioning lever, while the free end of arm 29' comprises a housing for embedding member 45 which is adapted to receive the element 43 for hooking the end of tie 41. As shown in FIG. 17, tie 41 extends from one arm 29 to the other arm 29' by surrounding the rear spoiler 4 upon which it rests in the locking position of the latching means 9. In this position, because of the tensioning of tie 41 by means of tension device lever 43, which is journalled on its hooking element 44, such as an axle, the arms 29 and 29' are maintained pressed against the corresponding walls of sleeve 7 and projections 11 remain nested in cavities 12 of rear spoiler 4. To release the rear spoiler 4 from the sleeve, as shown in FIG. 18 on the one hand, lever 43 is folded towards the rear, then disengaged from notch 46 of arm 29 and, on the other hand, arms 29 and 29' are pivoted towards the exterior at least until the projections 11 are disengaged from cavities 12 of rear spoiler 4.

Figure 18A:
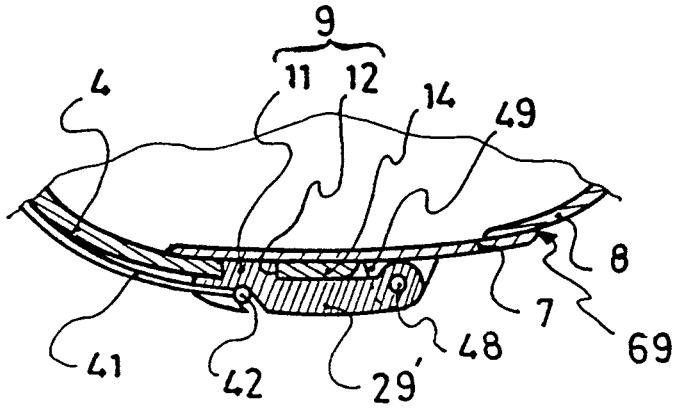

In this embodiment, as shown in FIGS. 17 and 18, wings 14 of rear spoiler 4 extend within sleeve 7. However, they can alternatively be arranged to extend outside the latter as is shown in FIG. 18*a*. In this case, arms 29, 29' are then journalled at 48 and/or have a portion providing a recess 49 with respect to the wall of sleeve 7 which is provided to allow the passage of wings 14 of spoiler 4 between them and the wall of sleeve 7. The projections 11 then engage directly in cavities 12 without having to extend through the wall of sleeve 7, the locking device 40 functioning in the same manner mentioned previously, in reference to FIGS. 17 and 18.

According to the foregoing description of the different embodiments of a boot according to the present invention, as illustrated in FIGS. 1–18*a*, the rear spoiler 4 is retained on sleeve 7 by means of latching means 9 which is facilitated either by using the elastic return qualities of wings 14 of spoiler 4 and/or of the wall of sleeve 7 joined to a device 10 for gripping and fastening of the front cuff, or by using a locking device 40 independent of the device 10 for fastening of upper 2 on the skier's lower leg. Other possibilities for locking the latching means 9 are also contemplated by a combination of the means mentioned above. Thus, the first alternative is provided in the embodiments of boots according to FIGS. 1 and 11 where the gripping and fastening device 10 of upper 2 on the lower leg ensures, simultaneously with its fastening which causes the coming together of the front cuff 8 towards the lower leg, the retention of wings 14 of rear spoiler 4 against the wall of sleeve 7 and, thus, the locking of latching means 9. It is the same in the example of FIG. 5, but with a different structural arrangement in which the gripping and fastening device 10 encircles, by means of its tie 15, the entire front part of upper 2 and extends towards the rear near latching means 9 where it is guided by a return element 51, to then come onto rear spoiler 4 which supports the hooking rack 17 of tension device 16. In this embodiment, the tensioning of the gripping and fastening device 10 has no effect on the position of rear spoiler 4 with respect to sleeve 7 due to the existence of latching means 9, but tends to retain the sides of sleeve 7 against wings 14 of said rear spoiler 4.

On the other hand, according to another alternative as illustrated in FIG. 8, the locking device 50 can be independent of the gripping and fastening device 10 and simply consist of a loop-hook system 52–53 located, respectively, on wing 14 of rear spoiler 4 and on the corresponding wall of sleeve 7, preferably near the latching means 9.

Moreover, numerous embodiments of the structure of the front part of upper 2 are possible without going beyond the scope of the invention. Thus, for all of the embodiments described previously, the front cuff 8 is generally provided to be journalled to, or otherwise move relative to, the lower front part 56 of sleeve 7. More particularly, in the example of FIGS. 1, 4, 8, 11, and 12, the front cuff 8 is journalled outside the lower front part 56 of sleeve 7 about two linkage axes 57 located substantially on both sides of said front part 56 and extends upwardly within sleeve 7. Sleeve 7 has, in its front part, a vertical opening 58 opening upwardly and defined substantially by the shape of a "U". Thus, by acting on the gripping and fastening device 10, the front cuff 8 pivots on its axes 57 and its upper part approaches the lower leg. Simultaneously, the gripping and fastening device 10 resting either on the wings 14 of rear spoiler 4 (FIGS. 1, 11, and 12) or on the exterior of sleeve 7 (FIGS. 4 and 8), causes the closing of the vertical opening 58 on the front cuff 8.

In the example of FIG. 5, the front cuff 8 is journalled also outside the front part 56 of sleeve 7 but simply by the overlapping of two lateral lugs 59 and, as mentioned previously, extends upwardly within sleeve 7. The tie 15 of the gripping and fastening device 10, surrounding the entire front part of upper 2, by resting on sleeve 7, again ensures the closing of the opening 58 of the latter on front cuff 8. On the other hand, in the example of FIG. 7, the front cuff 8 is journalled in 61, but within the lower front part 56 of sleeve 7 which has no front opening.

FIGS. 19, 20, 21, and 22, which follow, show other possible structures of the front part of upper 2. For certain ones, they lead to structures of sleeve 7 adapted to each one of these front parts of a boot, which is object of the invention. For clarity, the gripping and fastening device 10 described in the preceding figures has not been shown but is to be included in these structures.

Figure 19:
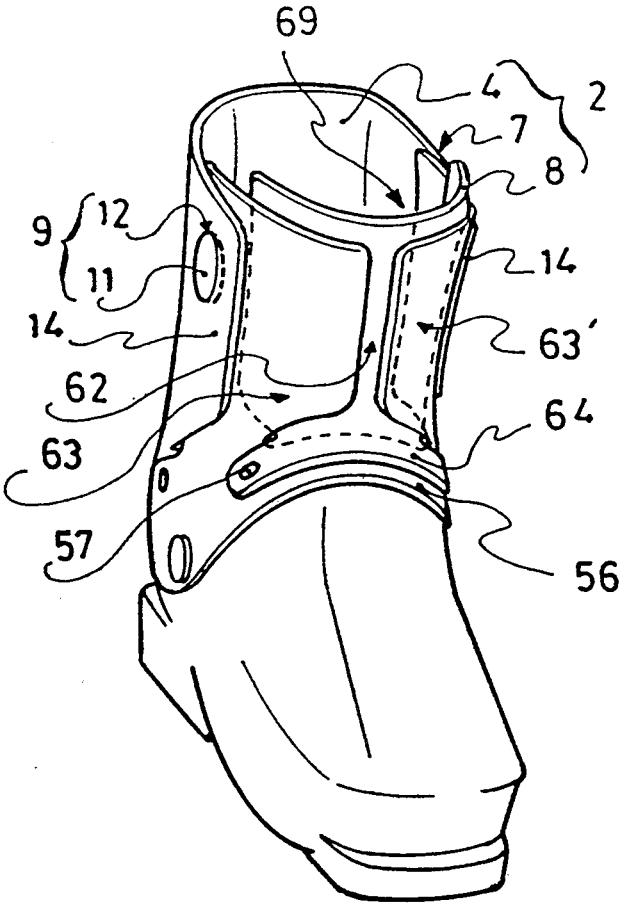
FIGS. 19–22 show various embodiments of the front part of the upper and the front cuff of a boot according to the invention on which, for clarity of the drawings, the fastening device of the upper has been omitted.

Thus, FIG. 19 partially illustrates a boot conforming to the invention in which the front part of sleeve 7 has an opening 62 in the shape of an inverted "T" upwardly open and defining two deformable tongues 63, 63' under which extends the front cuff 8 whose lower edge 64 is passed through the horizontal slit of opening 62 and is journalled outside the lower front part 56 of sleeve 7. As shown, the wings 14 of rear spoiler 4 extend partially on the outside of sleeve 7. Thus, by using a gripping and fastening device 10 of the type described previously, whether it is supported by sleeve 7 or rear spoiler 4, or even by wings 14, the gripping of the front cuff 8 against the lower leg is achieved by the flexion of the deformable tongues 63, 63' which push the cuff 8. The front cuff 8 can also be mounted totally on the exterior of the front part of sleeve 7, and thus cover the deformable tongues 63, 63'. The tensioning of the gripping and fastening device 10 will then cause the rocking of the cuff 8 on the deformable tongues 63, 63' which flex in the direction of the skier's lower leg.

Figure 20:
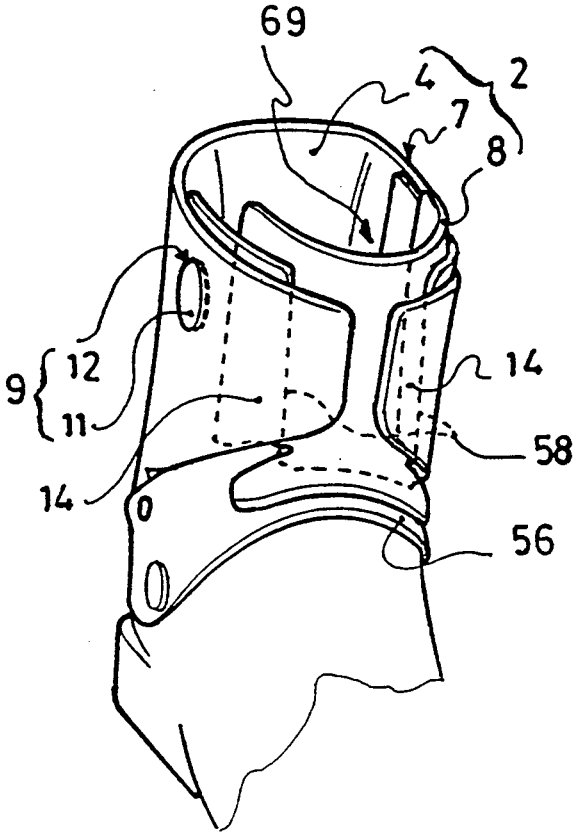

According to FIG. 20, the front part of sleeve 7 has a vertical opening 58 opening upwardly and defined substantially by the shape of a "U" under which extends the front cuff 8, as was seen in FIGS. 1, 4, 5, 8, 11, and 12, but in this example, the wings 14 of rear spoiler 4 partially cover the front part of sleeve 7. The implementation of the gripping and fastening device 10 then causes the coming together of the wings 14 of the rear spoiler 4 simultaneously against front cuff 8 and the opening 58 which then tends to close.

Figure 21:
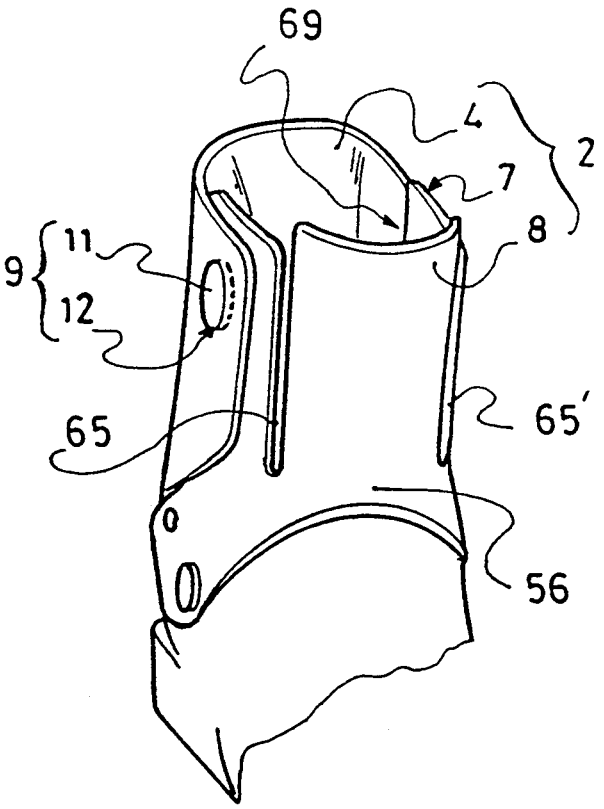

More simply, in FIG. 21, the front part of sleeve 7 has two vertical slits 65, 65' opening upwardly and defining between them the front cuff 8. The journalling of the latter with respect to the lower front part 56 of sleeve 7 is then achieved by the appropriate flexibility of the constituent material of the sleeve and/or of a zone of lesser thickness, for example. In this embodiment, the gripping and fastening device 10 causes the rocking of front cuff 8 against the lower leg and tends to substantially bring together the exterior edges of slits 65, 65' towards the interior of the upper, against said cuff 8.

Figure 22:
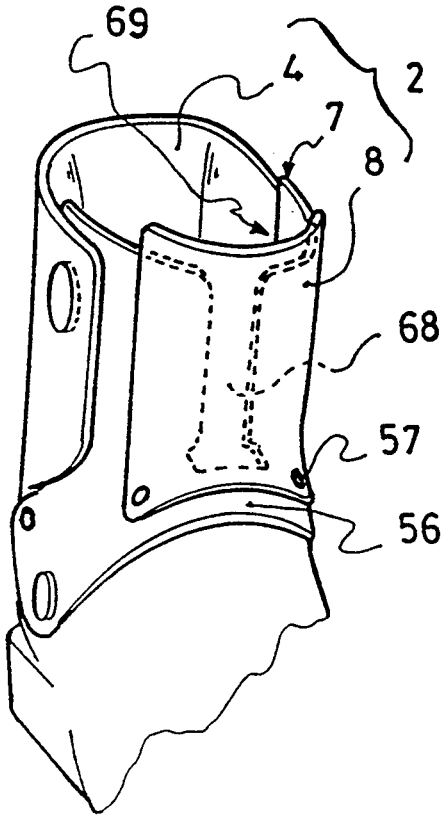

In FIG. 22, sleeve 7 is provided with a vertical substantially U-shaped opening 68, which opens upwardly and which the front cuff 8 covers totally on the exterior, from its journalling 57 on the lower front part 56 of the sleeve. In this embodiment, the tensioning of the tightening and fastening device 10 makes the front cuff 8 rock against the lower leg by causing the closing of the vertical opening 68.

Figure 2:
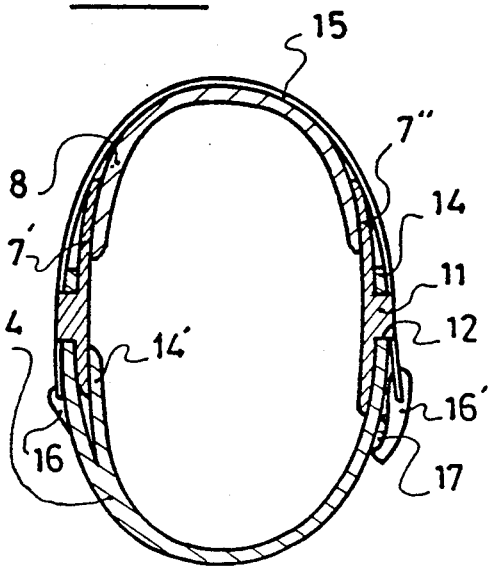

Without going beyond the scope of the invention, different arrangements of the constitutive elements of the boot can be modified. Thus, for example, wings 14 of the rear spoiler 4 can be obtained either in one piece with the spoiler, for example by molding, or mounted by mechanical assembly on the latter and have an inner extension for sealing 14' such as illustrated in FIG. 2 and in FIGS. 23–27 which follow.

Thus, according to the alternative embodiment of the boot shown in FIGS. 23–25, the latching wings 14 of the rear spoiler 4 are each mounted and assembled mechanically on the latter by means of a screw 80 and nut 81 locking assembly which makes it possible to rigidly lock the spoiler with the wings 14. The latter have a support shoulder 82 which extends, when the rear spoiler is pivoted in the closed position of the upper, against the edge of the rear opening 69 of sleeve 7, at least in the upper zone of the upper, at the level of latch 9 and of the screw 80 and nut 81 locking assembly. The adjustment of the relative position of the wings 14 with respect to the rear spoiler 4 is achieved by means of a succession of teeth 83', constituting a rack 83, provided on the latter and, complementarily, on the support shoulder 82 of the wings 14. These teeth extend over an angular sector corresponding at least to the different possibilities of adjustment, for example from 15–21 degrees, and are convergent on the journal axis 5 of rear spoiler 4. In this embodiment of the invention, the different possibilities of adjustment are arbitrarily predetermined by three holes for positioning the screw on the rear spoiler, each hole corresponding to a different angle marked by A, B, or C on the drawing, but can be provided continuously, tooth by tooth, while providing then a single oblong slot 85.

FIG. 25 illustrates means for retention by separation of the support shoulder 82 from the latching wing 14 with respect to rear spoiler 4. This retention means is constituted by a rivet 84 solidly affixed to shoulder 82, which rivet has a head 84' which extends on both sides of a sliding slot 85 made in rear spoiler 4. It is to be understood that slot 85 is concentric to the journal axis 5 of rear spoiler 4 and extends over an angular sector corresponding at least to that of the current maximal adjustment from position A to position C.

FIGS. 26 and 27 show an alternative embodiment of the invention in which the latching wings 14 are rigidly connected to the rear spoiler 4 by means of locking assembly 80–81 on rack 83 and a second screw 86 and nut 87 locking assembly situated on the rear lower part of wings 14. In this embodiment, another oblong opening 85 is likewise made, as in the example of retention means 84 of FIG. 25, at the level of the locking assembly 86–87 for the passage of screw 86 thereof and to thus allow the adjustment tooth 83' by tooth 83' of the rear spoiler 4 with respect to wings 14.

Although the present invention has been described with respect to specific embodiments, the embodiments are to be considered merely illustrative and not restrictive, various modifications being possible without departing from the scope of the present invention which is defined by the following claims.

We claim:

1. A ski boot comprising a shell base, an upper journalled at least partially on said shell base, and a means for fastening and tightening said upper on said lower leg, said ski boot having an open position and a closed position, said upper comprising:

(a) a central part defining a sleeve journalled with respect to said shell base about a first axis, said sleeve comprising extensions extending towards the rear from said first journal axis, said sleeve further comprising an upper part defining a front opening and a rear opening defined by two lateral walls of said sleeve;

(b) a rear spoiler journalled about a second axis positioned rearwardly of said first axis, said second axis extending through said extensions of said sleeve, said rear spoiler being adapted to close said rear opening of said sleeve; and (c) a front cuff moveable with respect to a forward area of said sleeve when in said open position, and being adapted to close said front opening of said sleeve;

wherein said rear spoiler and said front cuff are moveable with respect to said central part in said open position, and said rear spoiler and said front cuff are moveable with said central part about said first axis in said closed position.

2. The ski boot of claim 1, further comprising means for latching said rear spoiler and said sleeve, ensuring the holding in closed position of said rear spoiler on said sleeve, whereby said front cuff is adapted to be held in a closed position on said front cuff on a front part of said sleeve by means of said fastening and tightening means.

3. The ski boot of claim 2, wherein said latching means and said fastening and tightening means are positioned at different heights on said upper.

4. The ski boot of claim 3, wherein said latching means and said fastening and tightening means are positioned at generally the same height on said upper.

5. The ski boot of claim 2, wherein said rear spoiler is held in a latched position on said sleeve independently of said fastening and tightening means on said front cuff.

6. The ski boot of claim 2, wherein said rear spoiler is held in a latched position on said sleeve by means of said fastening and tightening means on said front cuff.

7. The ski boot of claim 1, wherein said latching means are positioned both on said rear spoiler and on said sleeve for selectively positioning said rear spoiler and said sleeve relative to each other.

8. The ski boot of claim 7, wherein said latching means comprise raised elements, which extend transversely to the thickness of said walls of said upper, and hollowed portions which cooperate with said raised elements.

9. The ski boot of claim 8, wherein said raised elements are shaped complementary to that of said hollowed portions, and wherein said raised elements are positioned on one of said rear spoiler and said sleeve, and said hollow portions are positioned on the other of said rear spoiler and said sleeve.

10. The ski boot of claim 9, wherein one of said raised elements and said hollow portions is arranged on one of said rear spoiler and said sleeve and further comprises means for adjusting the position of said one.

11. The ski boot of claim 10, wherein said position adjustment means comprise a succession of grooves provided in said hollow portions, generally coaxial with said first axis, and ribs affixed to said raised elements, and wherein said ribs cooperate with said grooves.

12. The ski boot of claim 10, wherein said position adjustment means comprise a reversible offset ring positioned in said wall of said sleeve, said ring ensuring the position of said raised element by means of a threaded rod extending through said wall of said sleeve, said raised element being adapted to lodge in said wing of said rear spoiler.

13. The ski boot of claim 8, wherein said raised elements and said hollow portions comprise engagement ramps for facilitating the nesting of said raised elements and said hollow portions during fastening of said rear spoiler on said upper.

14. The ski boot of claim 7, further comprising means for locking said raised elements and said hollow portions of said latching means in position.

15. The ski boot of claim 1, wherein said rear spoiler comprises two lateral wings extending in a direction to be adjacent said lateral walls of said sleeve, wherein said lateral wings comprise one of said raised elements and said hollow portions of said latching means.

16. The ski boot of claim 15, wherein said wings of said rear spoiler are elastically deformable in a direction generally transverse to the longitudinal axis of the boot.

17. The ski boot of claim 16, wherein said wings are provided as a single piece molded with said rear spoiler.

18. The ski boot of claim 16, wherein said wings are provided as independent elements each provided with a mechanical connection assembly.

19. The ski boot of claim 15, wherein said wings of said rear spoiler at least partially cover said walls of said sleeve in a fastened position of said upper.

20. The ski boot of claim 15, wherein said wings of said rear spoiler extend interiorly of said walls of said sleeve in a fastened position of said upper.

21. The ski boot of claim 1, wherein said lateral walls of said sleeve extend towards the rear of said upper in an manner adjacent to said lateral wings of said rear spoiler.

22. The ski boot of claim 21, wherein said lateral walls are elastically deformable in a direction generally transverse to the longitudinal axis of said boot.

23. The ski boot of claim 1, further comprising an adjustment device positioned between said shell base and said sleeve for effecting angular adjustment of said sleeve in an antero-posterior direction.

24. The ski boot of claim 1, further comprising an abutment provided on said shell and wherein said sleeve cooperates with said shell base during rearward biases by means of said abutment.

25. The ski boot of claim 1, wherein said fastening and tightening means comprises at least one flexible, generally inextensible linkage element resting on said front cuff and means for hooking and tensioning said flexible tie located on one of said rear spoiler and said sleeve.

26. The ski boot of claim 25, wherein said hooking and tensioning means are located on each of the sides of said upper.

27. The ski boot of claim 1, wherein said fastening and tightening means comprises at least one flexible, generally inextensible linkage element resting on said front cuff and return means for said tie located on each side of said upper on said sleeve and means for tensioning said linkage element located on a rear portion of said rear spoiler, wherein guidance means are provided to hold said tie in position on said front cuff.

28. The ski boot of claim 1, wherein said front opening of said sleeve is totally covered by said front cuff.

29. The ski boot of claim 1, wherein said front opening of said sleeve is closed by said front cuff, and wherein said front cuff extends partially within said upper and is journalled outside of and on a lower front part of said sleeve.

30. A ski boot comprising a shell base, an upper journalled at least partially on said shell base, and a means for fastening and tightening said upper on said lower leg, said ski boot having an open position and a latched position, said upper comprising:

(a) a central part defining a sleeve journalled with respect to said shell base about a first axis, said sleeve comprising extensions extending towards the rear from said first journal axis, said sleeve further comprising an upper part defining a rear opening defined by two lateral walls of said sleeve;

(b) a rear spoiler journalled about a second axis positioned rearwardly of said first axis, said second axis extending through said extensions of said sleeve, said rear spoiler being adapted to close said rear opening of said sleeve;

(c) a front cuff movable with respect to a lower forward area of said sleeve when in said open position, and being adapted to cover and provide tibial support for the skier within said sleeve; and (d) means for latching said rear spoiler to said sleeve in said latched position, wherein said front cuff is subjected to the action of said means for fastening and tightening, and wherein said rear spoiler and said front cuff are movable with said central part about said first axis in said latched position.

31. A ski boot having an open position and a closed position, said ski boot comprising;

(a) a shell base;

(b) an upper journalled on said shell base, said upper comprising:

(i) a central portion journalled with respect to said shell base, said central portion having a front opening and a rear opening defined by two lateral walls of said central portion;

(ii) a rear spoiler connected to said central portion for closing said rear opening of said central portion; and (iii) a front cuff connected to said central portion for closing said front opening of said central portion; and (c) means for fastening and tightening said upper on said lower leg;

wherein said rear spoiler and said front cuff are movable with said central portion with respect to said shell base when in said closed position.

32. The ski boot of claim 31, wherein said central portion is journalled about a first generally horizontal axis with respect to said shell base, and wherein said rear spoiler is journalled about a second generally horizontal axis on said central portion rearward of said first axis.

33. The ski boot of claim 31, wherein said central portion is journalled about a first generally horizontal axis with respect to said shell base, and wherein said rear spoiler is journalled about a second generally vertical axis on said central portion rearward of said first axis.

34. The ski boot of claim 31, further comprising means for latching said rear spoiler on said central portion.

35. The ski boot of claim 34, wherein said means for latching said rear spoiler on said central portion is locked in a predetermined position by said means for fastening and tightening.

36. The ski boot of claim 34, wherein said means for latching said rear spoiler on said central portion is locked in a predetermined position by means independent of said means for fastening and tightening.

37. The ski boot of claim 36, wherein said independent means comprises a locking device which includes a linkage element which extends from one lateral wall of said central portion to another of said lateral walls.

38. The ski boot of claim 31, wherein said rear spoiler comprises a pair of wings which extend adjacent respective ones of said lateral walls of said central portion.

39. The ski boot of claim 38, wherein said wings are positioned interiorly of said lateral walls of said central portion at least in a closed position of said rear spoiler.

40. The ski boot of claim 38, wherein said wings are positioned exteriorly of said lateral walls of said central portion at least in a closed position of said rear spoiler.

41. The ski boot of claim 38, wherein said latching means comprises a raised member and a cooperating depression on respective ones of said lateral walls of said central portion and respective ones of said wings of said rear spoiler.

42. The ski boot of claim 41, wherein said latching means further comprises means for adjusting the position of said rear spoiler on said central portion, said means for adjusting being independent of said means for fastening and tightening.

43. The ski boot of claim 31, further comprising means for angularly adjusting the longitudinal position of said central portion on said shell base.

44. The ski boot of claim 43, wherein said means for angularly adjusting the longitudinal position of said central portion on said shell base comprises a wedge insertable between a portion of said central portion and a portion of said shell base.

45. The ski boot of claim 31, wherein said front cuff completely covers said front opening of said central portion.

46. The ski boot of claim 31, wherein said front opening is closed by said front cuff, and wherein said front cuff extends partially within said upper and is mounted outside of said central portion and on a forward part of said central portion.

* * * * *